US005295348A

United States Patent [19]

Stahlecker et al.

[11] Patent Number: 5,295,348

[45] Date of Patent: * Mar. 22, 1994

[54] PROCESS AND APPARATUS FOR START SPINNING AT A MULTI-SPINNING STATION SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[ * ] Notice: The portion of the term of this patent subsequent to Mar. 23, 2010 has been disclaimed.

[21] Appl. No.: 854,867

[22] Filed: Mar. 19, 1992

[30] Foreign Application Priority Data

Apr. 5, 1991 [DE] Fed. Rep. of Germany ..... 4111000

[51] Int. Cl.[5] ..... D01H 13/04

[52] U.S. Cl. ..... 57/279; 57/90; 57/300; 57/304

[58] Field of Search ..... 57/281, 90, 279, 261, 57/280, 300, 301, 302, 303, 304, 305, 306, 308, 263, 328

[56] References Cited

U.S. PATENT DOCUMENTS

| | | | |
|---|---|---|---|
| 3,312,050 | 4/1967 | Noguera | 57/90 |
| 3,626,440 | 12/1971 | Harmon | 57/261 |
| 3,924,397 | 12/1975 | Stahlecker et al. | 57/301 |
| 4,497,166 | 2/1985 | Artzt et al. | 57/263 |
| 4,535,944 | 8/1985 | Nakahara et al. | 57/261 X |
| 4,679,389 | 7/1987 | Wolf | 57/304 |
| 4,761,946 | 8/1988 | Stahlecker | 57/328 |
| 4,773,208 | 9/1988 | Wolf | 57/304 X |
| 4,790,130 | 12/1988 | Stahlecker et al. | 57/261 |
| 5,095,689 | 3/1992 | Ferro et al. | 57/302 X |

FOREIGN PATENT DOCUMENTS

| | | |
|---|---|---|
| 2335740 | 11/1974 | Fed. Rep. of Germany . |
| 1015780 | 1/1966 | United Kingdom . |
| 1183208 | 3/1970 | United Kingdom . |

*Primary Examiner*—Joseph J. Hail, III

*Attorney, Agent, or Firm*—Evenson, McKeown, Edwards & Lenahan

[57] ABSTRACT

In the case of a spinning machine having a plurality of spinning stations spinning yarn from slivers and having transport devices for removing the slivers from cans and for guiding the slivers to the spinning stations, it is provided that, for the preparation of the start spinning of the spinning machine, the slivers are first deposited in receiving devices which are situated in the area of the outlet of the transport devices. Subsequently, the slivers are successively taken out of these receiving devices and are placed in the spinning stations.

24 Claims, 4 Drawing Sheets

PROCESS AND APPARATUS FOR START SPINNING AT A MULTI-SPINNING STATION SPINNING MACHINE

BACKGROUND AND SUMMARY OF THE INVENTION

The invention relates to a spinning machine and a process for operating a spinning machine having a plurality of spinning stations spinning yarn from slivers and having transport devices for removing the slivers from cans and for feeding them to the spinning stations, and to a spinning machine.

It is known in the case of an open-end spinning machine (German Patent Document DE-C 23 35 740) to arrange cans with the slivers to be spun on a platform above the spinning machine. The slivers are withdrawn by way of feeding rollers and are guided downward through perpendicular tubes to the spinning stations.

It is also known (British Patent Document 1 183 208) to feed the fiber material to be spun in the form of slivers to a ring spinning machine. In the case of this construction, the slivers are deposited in cans which are placed on a platform above the ring spinning machine. By way of feeding rollers, the sliver are guided to essentially perpendicularly extending guiding tubes in which they are guided to the drafting units of the individual spinning stations.

It is also known (British Patent Document 1 015 780) to feed slivers to the spinning stations of a ring spinning machine which are fed in cans. In the case of this construction, the cans are deposited in front of the spinning machine while leaving an operating aisle. By way of guiding rollers, the slivers are withdrawn from the cans and then are taken over by respective pairs of conveyor belts which guide the slivers to the drafting units of the spinning stations.

In the case of ring spinning machines, the feeding of slivers by means of cans has not found acceptance in practice. In order to obtain the desired fine yarn size, the drafting units must operate with high drafts. Since, however, in the case of ring spinning, the maximal delivery speed is limited at the outlet of the drafting units, this has the result that the feeding roller pairs of the drafting units must rotate at very low rotational speeds, that is, at rotational speeds of less than 1 $min^{-1}$ (one revolution per minute). In the case of long machines with a plurality of spinning stations, however, such low rotational speeds constructively cannot be implemented with acceptable expenditures in such a manner that the feeding roller pairs rotate at a uniform rotational speed. A non-uniform jerky rotation of the feeding roller pairs leads to irregular drafting in the slivers so that the spun yarn does not have a satisfactory quality.

According to an older German Patent Application (P 40 41 112.5), which is no prior publication, it is provided to feed finer slivers than previously particularly to ring spinning machines, that is, slivers of a fineness of approximately Nm 0.4 to approximately Nm 0.8. This has the result that the overall drafting of the drafting units can be reduced so that, despite the maximal delivery speed at the delivery roller pair of the drafting units, it is ensured that the feeding roller pairs of these drafting units rotate at sufficiently high rotational speeds which permit a rotation without any jerking. In the case of this construction, the fine slivers are guided from the cans to the spinning stations by means of transport devices in such a manner that no faulty drafting occurs during the transport.

It is an object of the invention to provide a process by means of which the operating of a spinning machine of the initially mentioned type is improved, particularly of a spinning machine which processes fine slivers in the range of from approximately Nm 0.4 to approximately Nm 0.8.

This object is achieved in that, for the preparation of the start spinning of the spinning machine, the transport devices are first switched on, then the slivers are placed in the transport devices and are fed by means of the transport devices to receiving devices situated in the area of the spinning stations, from which the slivers are removed and are placed in the spinning stations which are then started.

By means of this construction, the operation of a spinning machine is improved mainly because of the fact that a first start is improved, that is, a first starting of the spinning machine or a starting after a change of batches. In this case, new slivers must be fed to the spinning stations at all spinning stations. In the case of the process according to the invention, the slivers are successively placed in the transport devices assigned to the individual spinning stations, after which the slivers are then fed to the receiving devices which serve as a type of an intermediate storage device. After all slivers have been inserted, the slivers are taken out of the receiving devices and are placed in the spinning stations. Then, all spinning stations may be started simultaneously. Since the feeding speeds at which the slivers are guided by the transport devices out of the cans to the spinning stations, are relatively low, also in the case of a spinning machine having a plurality of spinning stations, no significant differences of length occur in the lengths of the slivers withdrawn from the cans, which slivers are successively placed in the individual transport devices. This has the advantage that the slivers of the individual cans are used up essentially simultaneously so that then also an essentially simultaneous change of all cans can be carried out.

Since the inserting of the slivers into the spinning stations is also carried out successively at the individual spinning stations, it is advantageous, in a further development of the invention, to switch the transport devices off again before the inserting of the slivers into the spinning stations and to switch them on again after the inserting when the spinning machine is started. Thus it is ensured that, during the time of the inserting of the slivers in the individual spinning stations, no varying lengths of slivers are removed from the cans. It is therefore possible that such a spinning machine is started only by the work of a single operator without any resulting significant differences in the lengths of the slivers withdrawn from the cans and without an excessive loss of fiber material during the start of the operation.

For carrying out the process, it is provided in the case of a spinning machine having several spinning stations for the spinning of slivers into a yarn and having transport devices for the removal of the slivers from the cans and for the guiding to the spinning stations, that the transport devices are followed by devices for the receiving of the slivers which are arranged outside the normal travelling path of the slivers from the transport devices to the spinning stations.

During a first start of the spinning machine, which naturally also includes a start after a batch change, the slivers travel into the devices for the receiving so that they are located at a defined point and also project out of the transport devices by a minimum length so that subsequently they can be introduced into the spinning stations, and particularly can be placed in the drafting units of these spinning stations. The slivers are therefore in each case located at defined points which are assigned to the individual spinning stations.

In a further development of the invention, it is provided that, below the transport devices, which feed the slivers from above downward to the spinning stations, devices are arranged for receiving the slivers. Thus, it is ensured that the slivers, already by virtue of their gravity, arrive at the devices for the receiving from the transport devices.

In a further development of the invention, it is provided that the devices for the receiving of the slivers are connected to a collecting device. In many cases, it will be necessary to cut the slivers, which are guided from the transport devices to the devices for the receiving, to a uniform length before the inserting into the spinning stations. The excess parts of the slivers will then be received by the collecting device so that they can be removed and may possibly be used again. In this case, it is expedient for the devices for the receiving of the slivers to be constructed as a device which extends over several spinning stations and in the longitudinal direction of the machine. As a result, the collecting of the sliver residues at one point will be facilitated.

In a further development of the invention, it is provided that the devices for the receiving of the slivers are arranged in the machine center of a two-sided spinning machine and are assigned to the spinning stations of both sides of the machine. As a result, only relatively low expenditures are required with respect to equipment.

In a further development of the invention, it is provided that the devices for the receiving of the slivers are developed as a trough which extends in the longitudinal direction of the machine and is open toward the top. As a result, it is possible to create purely mechanical devices for catching the slivers fed by the transport devices where the danger of an operational disturbance is very low.

In a further development of the invention, it is provided that the bottom of the trough is equipped with a conveyor belt extending in the longitudinal direction of the machine. This conveyor belt, which is driven continuously or preferably discontinuously, has the purpose of conveying the excess lengths of the slivers to a collecting device which is preferably arranged at a machine end.

In the case of another embodiment, it is provided that the trough, in its bottom area, is preferably provided with closable intake devices. By means of these intake devices, of which preferably one respectively is assigned to a spinning station, it is possible to make the slivers available at precisely defined points so that they can also be taken over in a simple manner by an automatic device which carries out the inserting into the spinning stations. When the intake devices are closable, this has the advantage that they can be made inoperative when they are not needed, that is, during the normal spinning operation.

In another development of the invention, it is provided that the devices for the receiving of the slivers are constructed as suction devices aimed at the area of the transport devices which delivers the slivers. These suction devices, of which preferably one respectively is assigned to one spinning station, also provide that the slivers are made available at defined points.

Other objects, advantages and novel features of the present invention will become apparent from the following detailed description of the invention when considered in conjunction with the accompanying drawings.

DETAILED DESCRIPTION OF THE DRAWINGS

Figure 1:
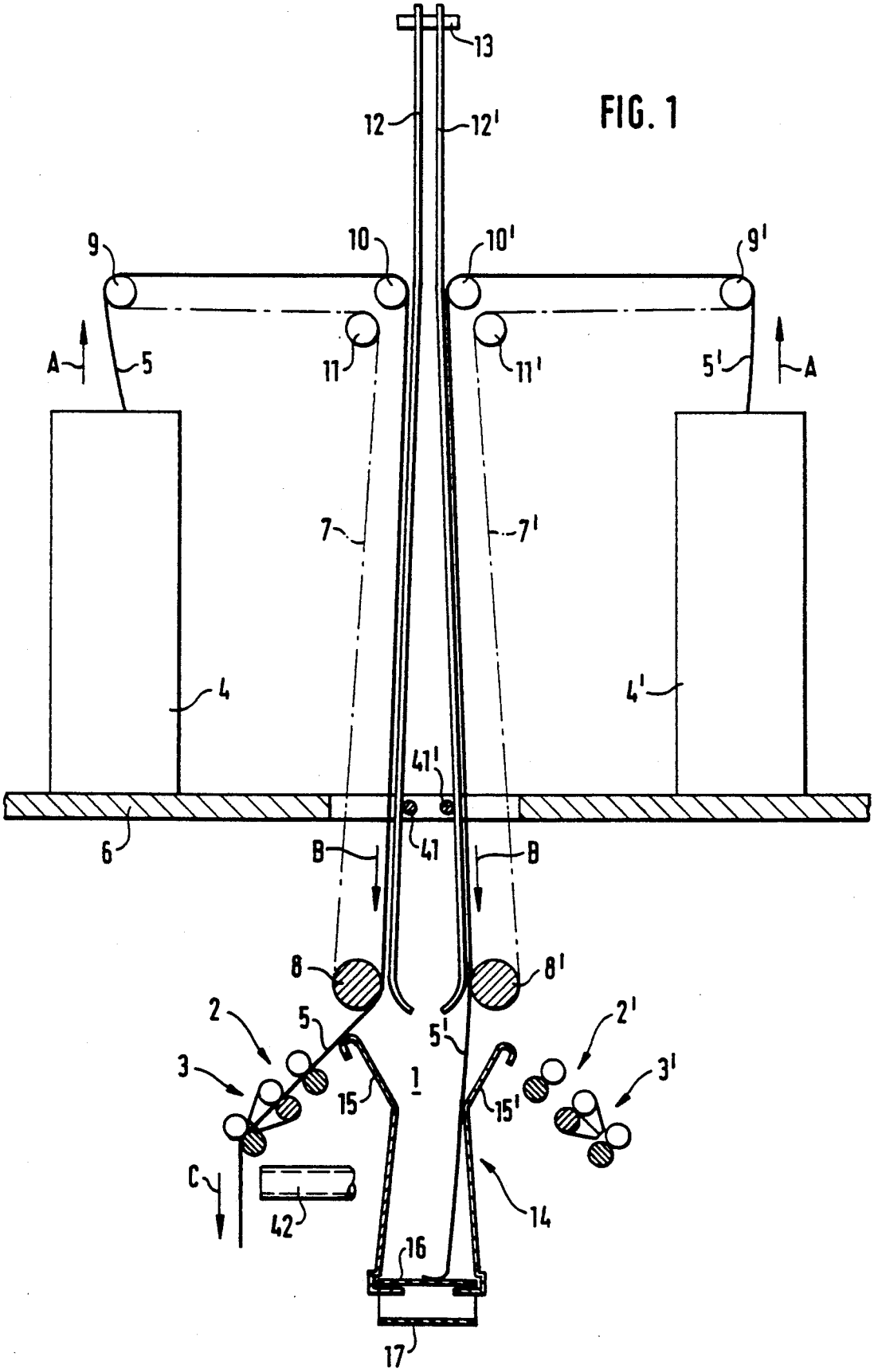
FIG. 1 is a schematic representation of a partial sectional view of a ring spinning machine which spins slivers into yarns which are removed from the cans which are deposited above the spinning machine on a platform, constructed according to a preferred embodiment of the invention.

The spinning machine 1, which is only outlined in FIG. 1, on both sides of the machine, is equipped with a plurality of spinning stations 2, 2' which are each arranged in a row behind one another. Of these spinning stations 2, 2', only drafting units 3, 3' are shown which are constructed as three-cylinder drafting units. The drafting units 3, 3' supply the sliver 5, which is drafted to the desired yarn size, to twisting elements which are not shown, specifically to ring spindles, in the direction of the arrow (C). Alternatively, other twisting elements, such as wind-around spindles or air nozzles, or the like, may also be used.

A can 4 is assigned to each spinning station 2, 2' from which the sliver 5, 5' to be spun is taken. The cans 4, 4' are arranged above the spinning machine 1 on a platform 6. As a rule, the diameters of the cans 4, 4' are larger than the dividing distance of the spinning stations 2,2' so that the cans 4,4' are deposited in two or more rows above each side of the machine on the platform 6.

The slivers 5, 5', which are withdrawn from the cans 4, 4' upwards (direction of arrow A), are in each case transported to the drafting units 3, 3' by means of conveyor belts 7, 7'. As shown particularly in FIG. 1, the conveyor belts 7, 7' are guided by means of the reversing rollers 8, 9, 10, 11 in such a manner that they have an angular course. The lower reversing rollers 8, 8', which are situated relatively close to the drafting units 2, 2', are constructed as driving rollers. The reversing rollers 8, 8' sit on driven shafts extending through in the longitudinal direction of the machine. The reversing rollers 8, 9, 10, 11 determine the course of the conveyor belts 7, 7' in such a manner that the latter start at least approximately centrically above the respective pertaining can 4, 4' and then extend approximately horizontally to the machine center where they are then guided in the direction of the arrow (B) approximately perpendicularly downward. In the area, of the approximately perpendicular leg, the downward extending conveyor belts 7, 7' are opposite sliding skids 12, 12' which are pivotally suspended with their upper end on a rail 13 extending through in the longitudinal direction of the machine and which, in the area between the reversing rollers 8, 10; 8', 10', are supported in the direction of the conveyor belts 7, 7' by means of rods 41, 41' extending through in the longitudinal direction of the machine.

The drafting units 3, 3' are arranged below the lower driven reversing rollers 8, 8' and are offset in each case toward the outside and extend at an angle of approximately 45°. During the normal spinning operation, as shown for the left machine half in FIG. 1, the slivers 5 travel from the lower driven reversing rollers 8 into the drafting units 3. Below the drafting units 3, 3', an intake device 42 is arranged in a conventional manner which is assigned to the delivery roller pair and which is shown only for the left half of the machine. The drafted sliver 5 is sucked into this intake device 42, should a yarn breakage have occurred in the area of the twisting element.

A trough 14 is arranged in the machine center below the reversing rollers 8, 8' which is open toward the top and which is bordered by two lateral walls 15, 15' expanding on top to a V-shape. The upper rounded edges of the lateral walls 15, 15' project into the area of the normal travelling path of the sliver 5, that is, into the travelling path which the sliver 5 takes in the normal operation, as illustrated in the left half of FIG. 1. The bottom of the trough 14, which is composed of sections corresponding to individual machine sections, is formed by a conveyor belt 16 which is guided in bent recesses of the lateral walls 15, 15'. As illustrated in FIG. 1, the returning end or run 17 of this conveyor belt 16 travels back underneath the trough 14.

Figure 2:
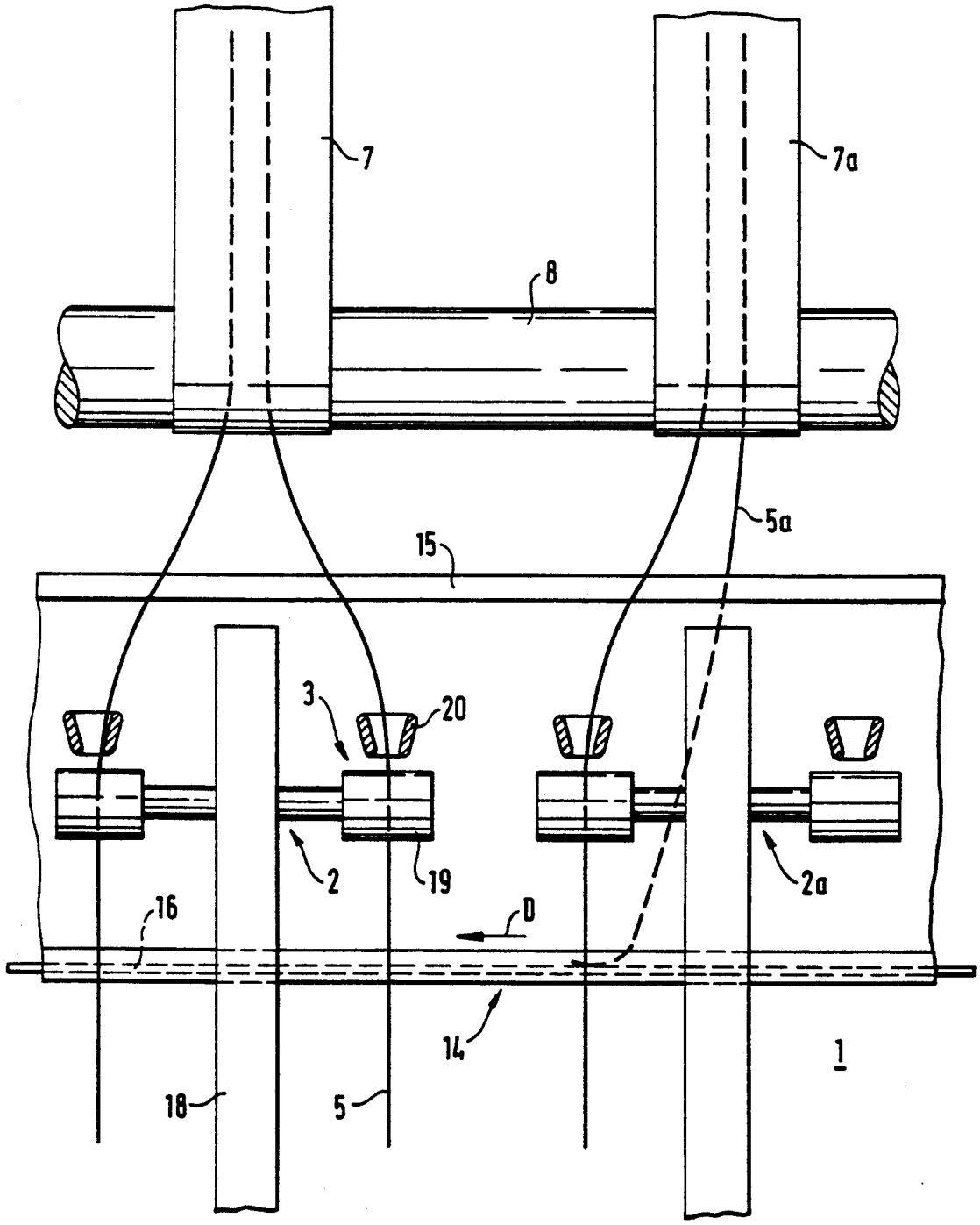
FIG. 2 is a partially sectional and enlarged lateral view of the spinning machine according to FIG. 1 in the area of the drafting units.

As shown in FIG. 2, which is an enlarged view of the spinning machine 1 in the area of the drafting units 3, the conveyor belts 7, 7*a* each transport two slivers 5 respectively. These are the slivers 5, which are part of two adjacent spinning stations, the drafting units 3 of which have a common loading arm 18 in which the pressure rollers 19 of the drafting units 3 are held which are constructed as pressure roller twins. A feeding hopper 20, which is shown as a sectional view in FIG. 2, is connected in front of each of the drafting units.

The troughs 14 carry out two functions (FIG. 2, right-hand side). One function consists of the fact that they receive a sliver 5*a* after a breakage has occurred in this sliver 5*a* so that this sliver will no longer enter into the pertaining drafting unit. This sliver 5*a* will then be received in an ordered manner and can be transported to the machine end by means of the conveyor belt 16 travelling in the direction of the arrow (D), where it is collected in a collecting device and may possibly be reused.

However, the second, much more significant position 14 of the trough 14 consists of the fact that it represents an auxiliary device which facilitates the start of the operation of the spinning machine 1; that is, the start of the operation of the spinning machine 1, in the case of a first start or after a batch change, when new cans 4, 4' with slivers 5, 5' are fed at all spinning stations. In this case, the slivers 5, 5' of the individual spinning stations are placed successively on the conveyor belts 7, 7 so that, when the drives of the conveyor belts 7, 7' are switched on, they are withdrawn in the direction of the arrows (A), are transported downward in the direction of the arrows (B) and are received by the trough 14. The placing of the slivers 5, 5' on the transport devices 7, 12; 7', 12' may also be carried out by an operator so rapidly that, in view of the relatively slow working speeds of the conveyor belts 7, 7', no significant differences occur in the withdrawn lengths of the slivers 5, 5'. After the slivers 5, 5' have reached the trough and project over the transport devices 7, 12; 7', 12' by a sufficient length which allows a placing into the drafting units 3, 3', the conveyor belts 7, 7' are stopped again. Subsequently, an operator can take the slivers 5, 5' out of the trough 14, cut them to the desired length, and place them in the drafting units 3, 3' so that then the whole spinning machine 1 is ready to start spinning. By means of the switching-on of the conveyor belt 16, the excess sliver lengths are then transported to the machine end in the area of a collecting device, so that they can be supplied for reuse purposes.

The removal of the slivers 5, 5' and the inserting into the transport devices 7, 12; 7', 12' as well as the removal from the trough may be carried out by an operator or by a corresponding automatic device who (or which) will then also take over the switching-on and the switching-off of the transport devices 7,12', 7', 12'.

By means of the above-described type of preparation of the start of the operation of the spinning machine it is ensured that the emptying of the cans 4, 4' starts simultaneously at all spinning stations 2, 2' for the spinning, without an excessive amount of sliver 5, 5' having been used up for the preparation. This has the result that all cans 4, 4' are spun empty at essentially the same time so that then also an essentially simultaneous exchange of cans can be carried out, in which case an operator or an automatic device, step by step, exchanges the can 4, 4' assigned to each spinning station for a full can 4, 4'. In this case, the spinning operation does not have to be interrupted because the starting piece of the sliver of a new can can be connected with the still entering end piece of the sliver of the now empty can.

Figure 3:
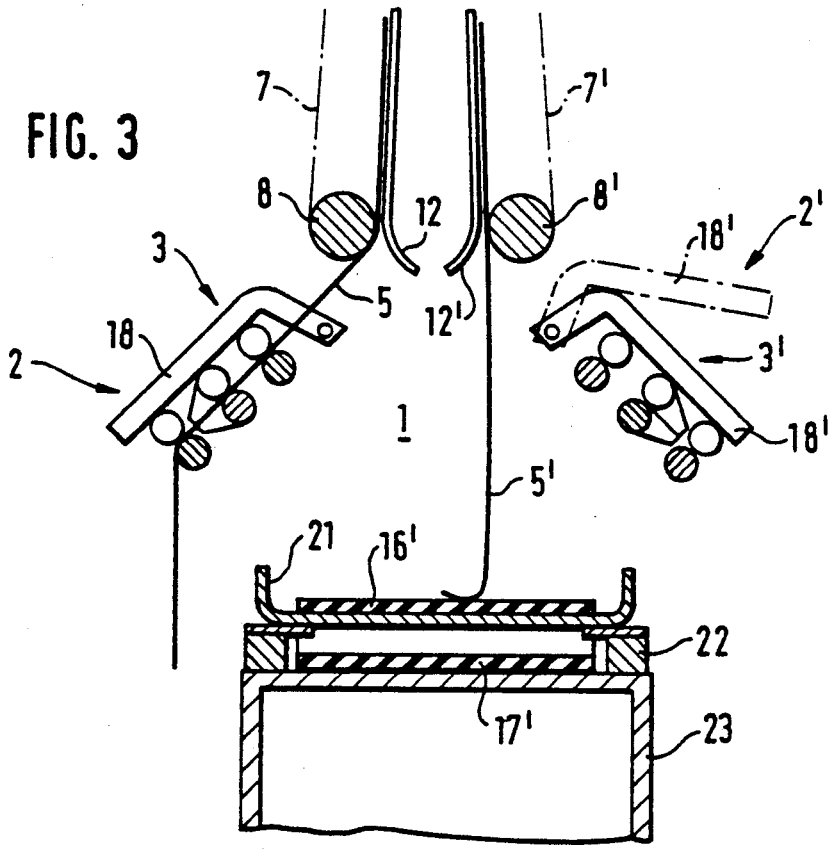
FIG. 3 is a partial sectional view similar to FIG. 1 of another embodiment with a conveyor belt used for receiving slivers.

FIG. 3 illustrates a simplified form of a trough 21 used for the catching of the slivers 5, 5', that is, a trough 21 which has no guiding surfaces projecting into the area of the sliver travelling path and which may possibly be eliminated completely. This trough then has a corresponding wider construction so that a sliver 5' delivered by the transport devices 7, 12; 7', 12' arrives securely in the area of the trough. The trough comprises a trough-shaped plate on which a conveyor belt 16' travels. By way of longitudinal rails 22, the plate is supported on a profile 23 of the spinning machine. The returning end 17' is guided back in the area between the trough 21 and the profile 23. In the case of such an embodiment, it may be expedient to construct the load carrier 18, 18' of the individual drafting units 3, 3', in its upper end facing the machine center, as a sliding surface so that, at least in the swivelled-away condition 18' which opens up the drafting unit 3', it operates as a sliding surface by means of which the sliver 5' is fed to the trough 21 or to the conveyor belt 16'.

Figure 4:
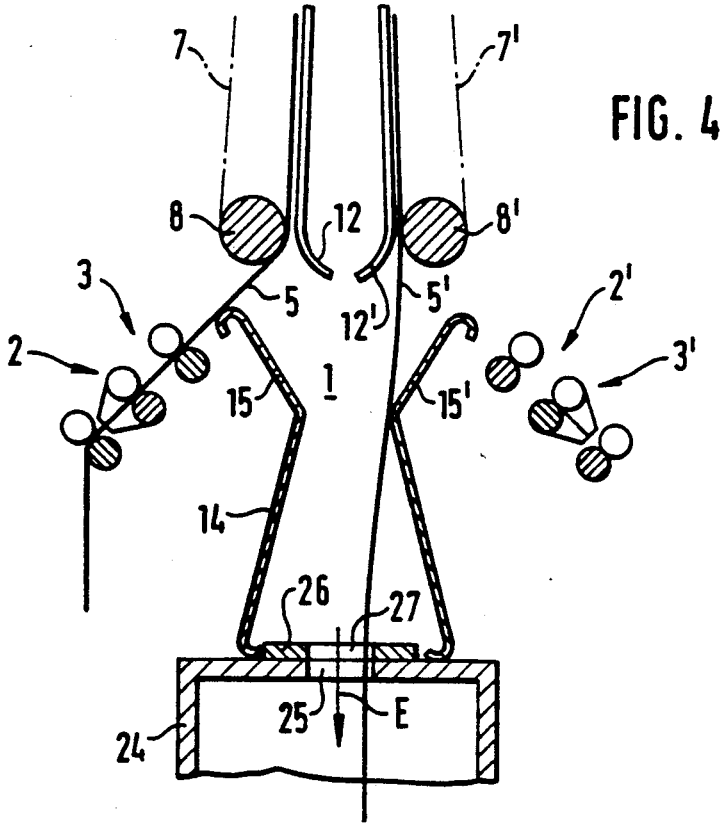
FIG. 4 is a partial sectional view similar to FIG. 1 of another embodiment of the invention in which the bottom of the devices for the receiving of the slivers is provided with intake devices.

The embodiment according to FIG. 4 corresponds to the embodiment according to FIG. 1 with respect to its essential construction. However, in this embodiment, the bottom of the trough 14 is formed by a slide 26 which extends in the longitudinal direction of the machine and is arranged on a vacuum duct 24 which extends in the longitudinal direction of the machine. The slide 26 is provided with openings 27 which, by means of a corresponding sliding of the slides 26 may be brought over openings 25 of the vacuum duct 24 so that then a suction air flow (E) will occur which sucks the slivers 5' into the suction duct 24. The suction duct is used for the removal of the excess lengths of the slivers 5'. By means of the sliding of the slide 26, the connection to the suction duct 24 may be interrupted.

Figure 5:
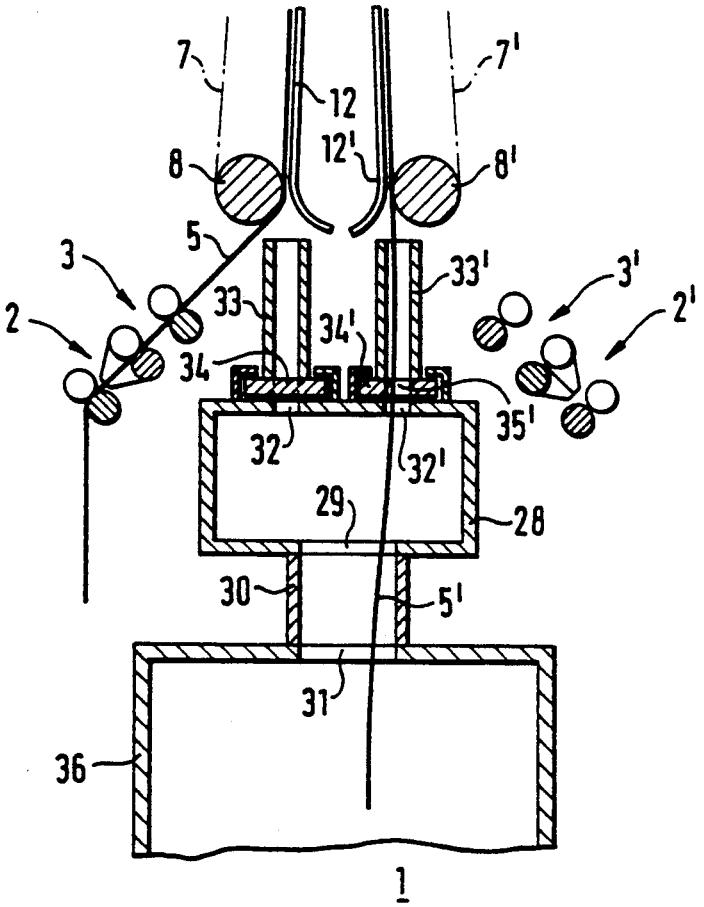
FIG. 5 is a partial sectional view similar to FIG. 1 of another embodiment of the invention with suction devices aimed at the delivery area of transport devices.

The spinning machine 1, which is partially shown in FIG. 5, with respect to the transport devices 7, 12; 7', 12' and the drafting units 3, 3', corresponds to the embodiment according to FIG. 1. In this embodiment, it is provided that an auxiliary suction duct 28 is connected by way of intermediate tubes 30 and openings 31, to a main suction duct 36 extending in the longitudinal direction, by way of openings 29. On this auxiliary suction duct 28, rails 34, 34' can be slid in the longitudinal direction of the machine which are provided with suction pieces 33, 33' which project upward to the delivery area of the transport devices 7, 12; 7', 12'; that is, to the area of the wedge-shaped gap between the driven reversing rollers 8, 8' and the sliding skids 12, 12'. The slides are provided with openings 34, 34' which are assigned to the suction nozzles 33, 33'. They may be coordinated with openings 32, 32' of the auxiliary suction duct 28 so that then a suction air flow is generated which affects the delivery area of the transport devices 7, 12; 7', 12'. By means of a corresponding sliding of the slides with the suction nozzles 33, 33', this connection may also be closed again which, as a rule, corresponds to the position for the normal operation.

Figure 6:
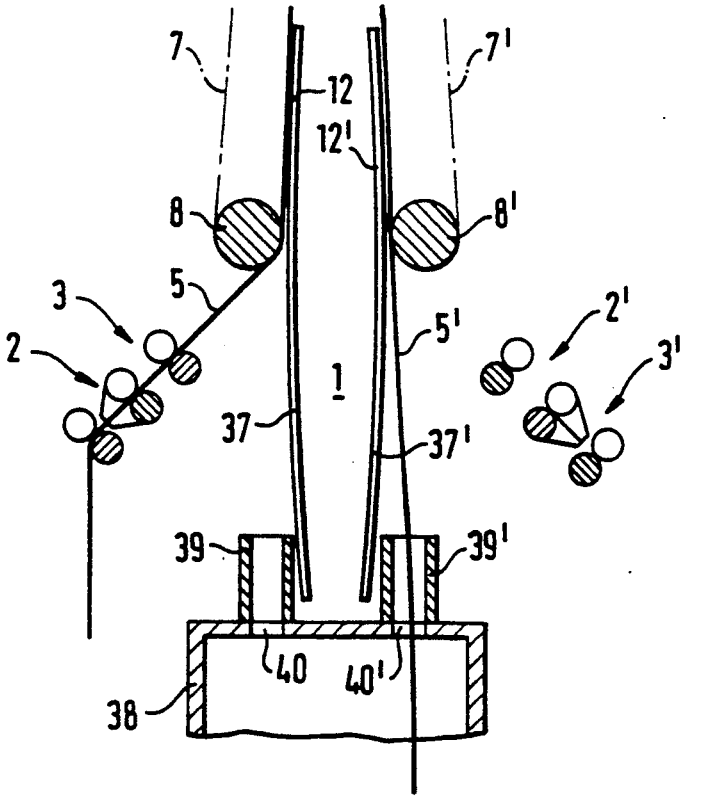
FIG. 6 is a partial sectional view of an embodiment similar to FIG. 5 in which intake devices are arranged at a larger distance below the transport devices and are connected with them by means of guiding elements.

In the case of the embodiment according to FIG. 6 which, with respect to the transport devices 7, 12; 7', 12' and the drafting units, corresponds to the embodiment according to FIG. 1, a suction duct 38 arranged in the machine center is provided with openings 40, 40' situated on top to which suction nozzles 39, 39' are connected which are arranged at a relatively large distance from the driven reversing rollers 8, 8' so that a constant suction effect is permissible here. In this embodiment, the sliding skids 12, 12' are provided with extensions 37, 37' which lead to the suction nozzles 39, 39'. These extensions 37, 37' therefore ensure that they guide the slivers 5, 5' to the suction nozzles 39, 39', in the case of a breakage and mainly also during the preparation of the start of the operation.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations for spinning sliver into yarn, each spinning station including a drafting unit, transport devices for transporting sliver from silver supply cans to the spinning stations, and receiving devices disposed downstream of the transport devices for receiving the slivers, said receiving devices being arranged outside the normal traveling path of the sliver from the transport devices to the drafting units of the spinning stations, said receiving devices including apparatus for removal of sliver deposited therein, whereby start spinning of the spinning machine is facilitated with removal of the slivers from the receiving devices and placement thereof in the spinning stations at a position upstream of the spinning station drafting units.

2. A spinning machine according to claim 1, wherein the receiving devices are arranged below the transport devices for receiving the slivers guided from above downward to the spinning stations.

3. A spinning machine according to claim 2, wherein the receiving devices are connected to a collecting device.

4. A spinning machine according to claim 1, wherein the receiving devices are connected to a collecting device.

5. A spinning machine according to claim 4, wherein the receiving devices are connected to the collecting device by way of conveying devices.

6. A spinning machine according to claim 5, wherein the receiving devices are constructed as a device which extends along several spinning stations and in the longitudinal direction of the machine.

7. A spinning machine according to claim 5, wherein the receiving devices are arranged in the machine center of a two-sided spinning machine and are assigned to the spinning stations of both sides of the machine.

8. A spinning machine according to claim 1, wherein the receiving devices are constructed as a device which extends along several spinning stations and in the longitudinal direction of the machine.

9. A spinning machine according to claim 1, wherein the receiving devices are arranged in the machine center of a two-sided spinning machine and are assigned to the spinning stations of both sides of the machine.

10. A spinning machine according to claim 9, wherein the receiving devices are constructed as a trough which extends in the longitudinal direction of the machine and is open toward the top.

11. A spinning machine according to claim 9, wherein the receiving devices are constructed as suction devices aimed at the area of the transport devices delivering the slivers.

12. A spinning machine according to claim 1 wherein the receiving devices are constructed as a trough which extends in the longitudinal direction of the machine and is open toward the top.

13. A spinning machine according to claim 12, wherein the bottom of the trough is provided with a conveyor belt extending in the longitudinal direction of the machine.

14. A spinning machine according to claim 12, wherein the trough is provided in its bottom area with closable intake devices.

15. A spinning machine according to claim 14, wherein the trough is arranged on a suction duct extending in the longitudinal direction of the machine.

16. A spinning machine according to claim 12, wherein the trough is laterally provided with guiding surfaces extending to the travelling path of the slivers from the transport devices to the drafting units.

17. A spinning machine according to claim 1, wherein the receiving devices are constructed as suction devices aimed at the area of the transport devices delivering the slivers.

18. A spinning machine according to claim 17, wherein the suction devices are connected to a suction line by way of switchable connecting elements.

19. A spinning machine according to claim 17, wherein the suction devices are arranged at a distance from the area of the transport devices delivering the slivers, and wherein the transport devices are provided with guiding elements leading to the suction devices.

20. A process for start spinning a spinning machine of the type including a plurality of spinning stations for spinning yarn from slivers, each spinning station including a drafting unit, and transport devices for removing the slivers from cans and for feeding them to the spinning stations, said process comprising the sequential steps of:

switching of the transport devices, placing slivers from the cans into the transport devices, operating the transport devices to feed the sliver to receiving devices located in the area of the respective spinning stations at a position upstream of the respective spinning station drafting units, said receiving devices including apparatus for removal of sliver deposited therein, removing the slivers from the receiving devices and placing the slivers in the spinning stations at a position upstream of the drafting units, and starting the spinning stations.

21. A process according to claim 20, comprising switching off the transport devices before the placing of the slivers into the spinning stations, and switching on the transport devices after starting the spinning stations.

22. A spinning machine comprising:

a plurality of spinning stations for spinning sliver into yarn, transport devices for transporting sliver from silver supply cans to the spinning stations, receiving devices for receiving the slivers, said receiving devices being arranged downstream of the transport devices and arranged outside the normal traveling path of the sliver from the transport devices to the spinning stations, wherein the receiving devices are arranged in the machine center of a two-sided spinning machine and are assigned to the spinning stations on both sides of the machine.

23. A spinning machine according to claim 22, wherein the receiving devices are constructed as a trough which extends in the longitudinal direction of the machine and is open toward the top.

24. A spinning machine comprising:

a plurality of spinning stations for spinning sliver into yarn, transport devices for transporting sliver from silver supply cans to the spinning stations, receiving devices for receiving the slivers, said receiving devices being arranged downstream of the transport devices and arranged outside the normal traveling path of the sliver from the transport devices to the spinning stations, wherein the receiving devices are constructed as a trough which extends in the longitudinal direction of the machine and is open toward the top, and wherein the bottom of the trough is provided with a conveyor belt extending in the longitudinal direction of the machine.

* * * * *